US005501499A

United States Patent [19]

Zitka

[11] Patent Number: 5,501,499

[45] Date of Patent: Mar. 26, 1996

[54] TOPLESS CONTAINER CARRIER

[76] Inventor: Frank L. Zitka, 3600 Buckley Rd., Racine, Wis. 53404

[21] Appl. No.: 262,676

[22] Filed: Jun. 20, 1994

[51] Int. Cl.[6] ..... B65D 71/00

[52] U.S. Cl. ..... 294/159; 294/87.2; 294/165; 294/168

[58] Field of Search ..... 294/27.1, 29, 32, 294/34, 87.1, 87.2–87.28, 143, 146, 159–168; 206/142, 143, 145, 151, 159–164, 201, 427, 429, 503, 506, 510; 211/71–74, 79, 85, 207, 208; 220/23.4

[56] References Cited

U.S. PATENT DOCUMENTS

| | | | |
|---|---|---|---|
| 2,312,256 | 2/1943 | Lumley | 294/159 |
| 2,511,569 | 6/1950 | Davis et al. | 206/429 |
| 2,519,149 | 8/1950 | McWethy et al. | 294/159 |
| 2,565,448 | 8/1951 | Brownell | 294/159 |
| 2,782,916 | 2/1957 | Goenen | 294/166 X |
| 2,905,500 | 9/1959 | Thombs | 294/34 |
| 3,203,580 | 8/1965 | Erickson | 206/145 |
| 3,203,581 | 8/1965 | Wherry | 206/159 |
| 3,693,830 | 9/1972 | Oglesbee | 206/162 |
| 3,913,778 | 10/1975 | Oglesbee | 294/159 X |
| 4,040,517 | 8/1977 | Torokvei | 206/510 X |
| 4,560,064 | 12/1985 | Peterson | 206/159 |
| 4,778,210 | 10/1988 | Paulson | 294/87.2 |
| 5,154,467 | 10/1992 | Lanius et al. | 294/143 X |

FOREIGN PATENT DOCUMENTS

| | | | |
|---|---|---|---|
| 8702332 | 4/1987 | WIPO | 294/87.2 |

*Primary Examiner*—Johnny D. Cherry
*Attorney, Agent, or Firm*—Arthur J. Hansmann

[57] ABSTRACT

A carrier for supporting topless containers for carrying items such as nails, screws, liquids, or the like. The carrier has a lower shelf for supporting the containers, and there are upper fingers for engaging the open end of the containers and releasably secure them to the carrier. The carrier is adjustable for accommodating containers of various heights, and two or more carriers can be stacked vertically either with or without containers thereon.

18 Claims, 2 Drawing Sheets

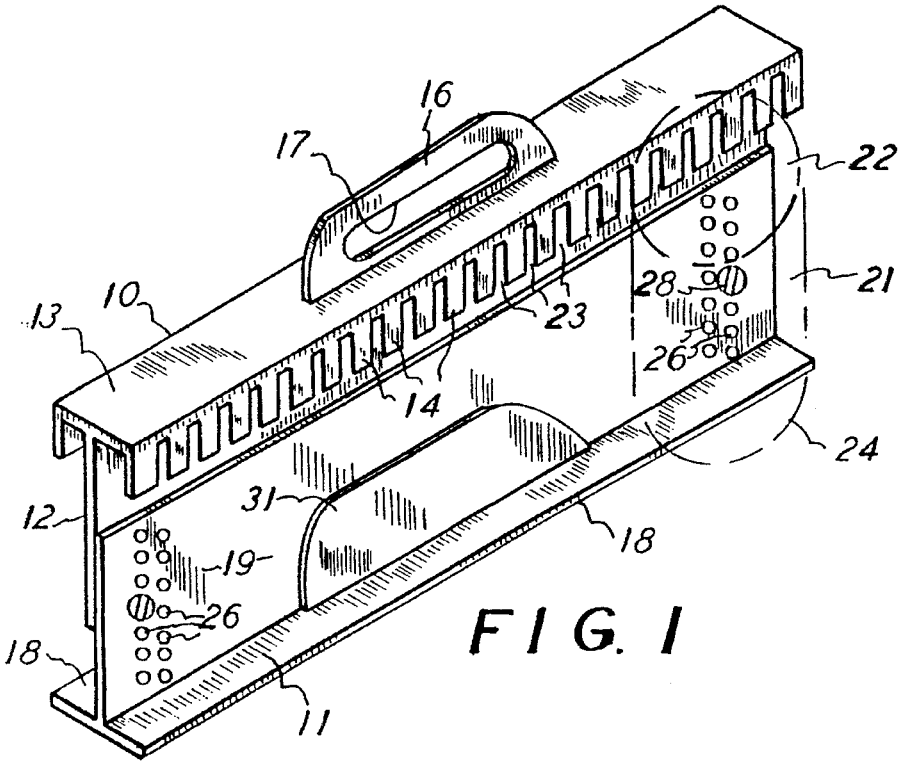
FIG. 1
FIG. 2
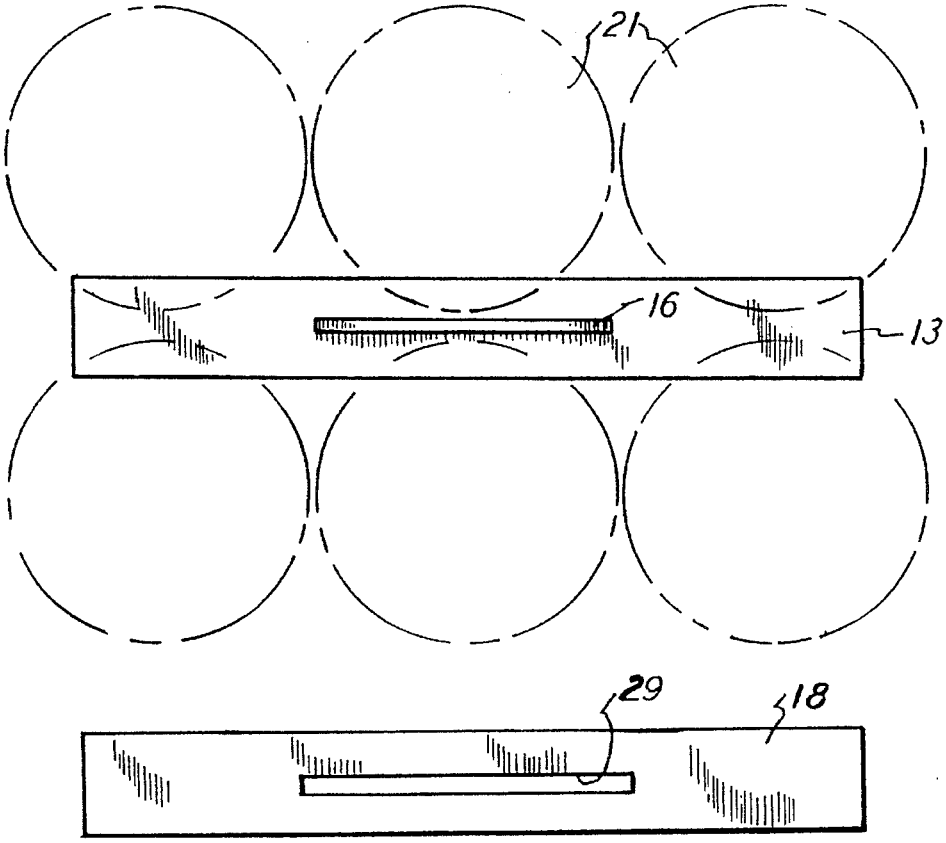
FIG. 6

FIG. 3
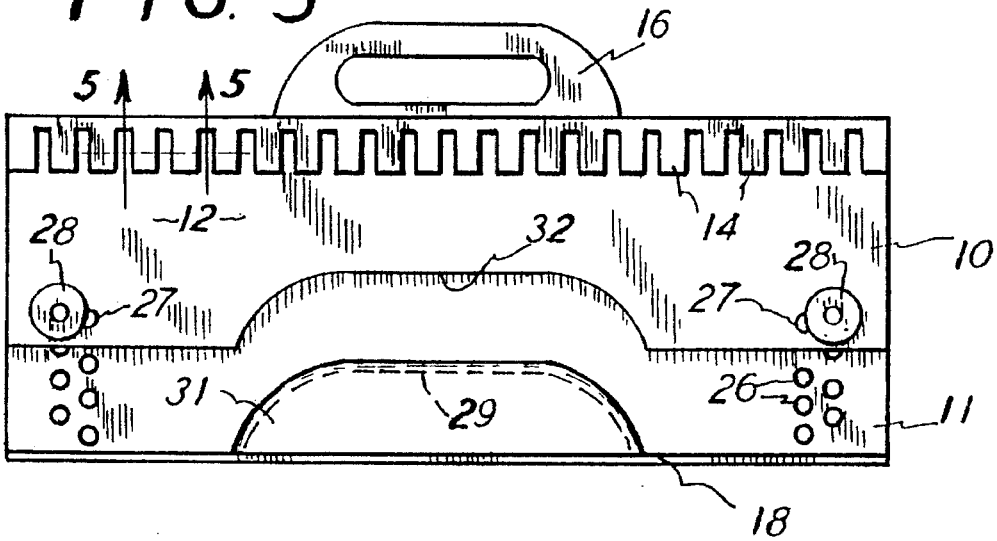
FIG. 4
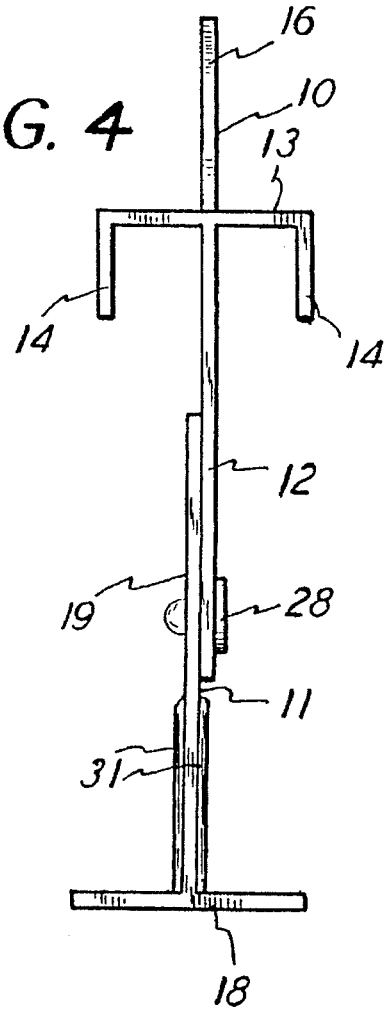
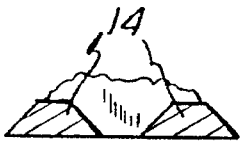
FIG. 5

TOPLESS CONTAINER CARRIER

This invention relates to a topless container carrier, and, more particularly, it relates to a carrier of topless containers which can contain various items and which are removable from the carrier.

BACKGROUND OF THE INVENTION

It is well known that there are various situations where a person has several open containers with various items, such as nails, bolts, and liquids, such as paint. These and other hardware and liquid products are desired at a particular work site or the like, and the person would have to transport and then position the containers one by one, and to re-position the containers when another location is desired.

The object of the present invention is to provide a carrier which can receive open containers for transporting various loose items or liquids to a work site or the like. The containers can be ordinary cans which are in common use by consumers of canned goods, and in these instances the cans will have been opened and emptied and their open tops are available for entrapment by the carrier so that the containers can be readily received and removed relative to the carrier. Still further, the carrier is arranged so that it can be adjusted to accommodate containers or cans of different heights.

Also, the carrier of this invention is arranged so that it can accommodate a plurality of ordinary household type of cans, and in the one embodiment of the carrier six ordinary cans can be accommodated, for instance. The containers can be of different heights and diameters, on one carrier.

Still further, the carrier of this invention is arranged to be inexpensive, light weight, and of a very minimal overall size so that it occupies only a minimal space, but yet is stable and sturdy for the purposes mentioned and required. Still further, the carrier is arranged so that two or more of the carriers can be vertically stacked upon each other and they retain their standing stability in the stacked position particularly when the containers supported by the carriers are balanced on opposite sides of the carrier.

The prior art is already aware of container carriers such as those disclosed in U.S. Pat. Nos. 3,203,581 and 4,560,064 and 4,778,210. The present invention differs from those disclosures in that the present invention provides the container carrier which has a lower shelf for supporting the container or can and which has upper slots or fingers for receiving or engaging the upper open end of the container. Still further, the present invention provides for the easy and quick insertion and removal of the containers relative to the carrier, and it provides for an adjustment in the overall height of the carrier to thereby support and accommodate containers of various heights. Finally, the other aforementioned features of this invention also distinguish this invention over the aforementioned prior art.

BRIEF DESCRIPTION OF THE DRAWINGS

FIG. 1 is a front perspective view of a carrier of a preferred embodiment of this invention, and showing one container supported thereon and shown in dot/dash lines.

FIG. 2 is a top plan view of the carrier of FIG. 1, and including the dot/dash lines showing of six containers thereon.

FIG. 3 is a back elevational view of the carrier of FIG. 1.

FIG. 4 is a left end view of FIG. 3, on a slightly enlarged scale.

FIG. 5 is a sectional view taken on the line 5—5 of FIG. 3.

FIG. 6 is a bottom plan view of the carrier of FIG. 1.

DETAILED DESCRIPTION OF THE PREFERRED EMBODIMENT

The drawings show that the carrier is of an elongated shape and narrow in width, and it is fundamentally symmetrical about its longitudinal plane and it is therefore balanced and self supporting in a freestanding position either alone or with containers thereon. Also, it can be made of plastic or metal or other sheetlike material, and it is arranged to be carried by a person's single hand.

The carrier is essentially made in two pieces and, as viewed from the end, such as seen in FIGS. 1 and 4, there is an upper substantially T-shaped piece 10 and a lower and inverted cross-shaped piece 11 in the assembled arrangement shown. As such, the end view of the carrier presents a T-shape, again as seen in FIGS. 1 and 4.

The piece 10 has a planar stem portion 12 which extends for the width of the carrier, and it has a transverse or head portion 13 which also extends for the width of the carrier. A plurality of depending fingers 14 are included in the head portion 13 and exist in a row of fingers 14 on each side of the head 13, as fully shown in FIG. 4. Also, the upper piece 10 has a handle portion 16 integral therewith, and there is a hand slot 17 which permits the user to insert the hand into the slot 17 and thus conveniently tote the entire carrier both with and without containers thereon.

The lower cross-shaped piece 11 has its base or shelf portion 18, which is planar, and has an upstanding planar and stem portion 19, and the two portions 18 and 19 also extend for the entire width of the carrier, as shown.

The two pieces 10 and 11 are assembled together, as shown in the drawings, to form the T-shape as seen in FIGS. 1 and 4.

In that arrangement, the carrier presents a planar lower shelf 18 and the downwardly extending fingers 14 which are spaced vertically above the shelf 18 and which extend parallel to the stem 12. A can or container 21, shown in dot/dash lines in FIGS. 1 and 2, can be supported on the carrier and transported therewith. The containers 21 are ordinary household cans which have had their tops removed, and the upper edge or lip 22 of the container 21 is engaged by the downward depending fingers 14 when the open top of the container 21 is inserted into the slots 23 adjacent each two of the fingers 14, as shown. The container 21 has been tipped into aligned position with the upright portion 19 of the bottom piece 11, and the container lower edge 24 is positioned on the shelf 18. As such, the container is securely held by the carrier until the container is again removed from the carrier by sliding its lower edge 24 off the shelf 18 and lowering the container so that its open upper edge 22 is moved downwardly and out of the slots 23 and away from the restraint of the depending fingers 14.

FIG. 2 shows that there may be a plurality of containers 21 supported on the carrier, and in fact six such containers are shown, with three on each side of the carrier, and thus there is balance in the entire assembly. Of course,the containers 21 would contain various items such as nails, bolts, tools, or even liquids, such as paints.

The shelf 18 is shown on both sides of the carrier and it presents a planar foot for the stable standing support of the carrier, as well as presenting the shelf support for the plurality of containers 21.

The stem portion 19 has a row of openings 26 on each end thereof, as shown in FIGS. 1 and 3. The stem portion 12 has two openings, such as the opening 27 shown in FIG. 3, on each end thereof, and the openings 26 and 27 can be aligned with each other. In that aligned relationship, a screw fastener 28 can extend through the aligned openings 26 and 27, at each end of the carrier, as shown in FIGS. 1 and 3. With that arrangement, the overall height of the carrier can be varied to accommodate containers of different or selected heights. Again, once the height of the carrier is established by the adjustability through the releasable fasteners 28 in the openings 26 and 27, then the appropriate containers 21 can be inserted into the carrier, as described.

FIG. 5 shows that the fingers 14 are actually of a beveled shape so that the upper open end of the container 21 can be more readily and securely inserted into the slots 23 adjacent the fingers 14. Of course, with the plurality of fingers 14 in a large number, such as shown, the diameter of the container 21 can be accommodated by inserting the container 21 into the two furthest spaced-apart slots 23 which will cause the container 21 to be secured in the upright position or immediately adjacent and parallel to the stem 19, as seen in FIG. 1. That is, the container 21 will not tip relative to the carrier when the container 21 is inserted into the slots 23 in accord with the spacing of the fingers and the diameter of the open top 22. As shown in FIGS. 1, 3, and 5, the fingers 14 and slots 23 are in a row in one flat plane on each side of the carrier. Also, the slots 23 are each of a width less than the width of each of the fingers 14 to restrain the sidewise movement of each container 21 by virtue of the trapping of the container upstanding wall between two closely spaced-apart fingers 14.

For purposes of stacking one carrier on top of another, the lower carrier piece 11 has a rectilinear slot 29 extending centrally through the lower shelf 18 and upwardly into the stem portion 19, as shown by the dotted line in FIG. 3. To accommodate the provision of the slot 29, the stem 19 has enlarged portions 31 on each side of the stem 19. Also, to accommodate the minimal or collapsed adjustment of the carrier's height, the stem portion 12 has a cutout 32 which mates with the enlarged projection 31 of the lower stem 19, as shown in FIG. 3. The slot or opening 29 is of a size of both length and width to receive the carrier handle 16 when one carrier is stacked upon the other and the carrier handle 16 will then be inserted into the slot 29. This provides for further stability, as well as compactness, when two carriers are stacked as mentioned.

Accordingly, the carrier is of a configuration which has its lower support shelf 18 and its upper finger portion 13 extending transverse to the upright plane of the carrier center wall or stems 12 and 19. The offset extent of the shelf 18 and the upper portion 13 are the same, and thus the carrier is of a minimal width, as seen in FIGS. 1 and 4.

Observing FIG. 3, the upper piece 10 can be placed angulated relative to the lower piece 11 simply by aligning holes 26 and 27 to accommodate the angulation. That is, the hole 27 which would be in alignment with the fastener 28 on the right-hand side of FIG. 3 would be aligned with the hole 26 in the left row, as viewed in FIG. 3. Correspondingly, the hole 27 which is aligned with the fastener 28 on the left-hand side, as viewed in FIG. 3, would be aligned with one of the holes 26 in the right-hand row on the left end as viewed in FIG. 3. Of course, the fasteners 28 would be placed in each of those two aligned holes 26 and 27 after the upper piece 10 is tilted relative to the lower piece 11. In that regard, the spacing between the shelf 18 and the fingers 14 on the right-hand side of the carrier would be different from that comparable spacing on the left-hand side of the carrier. In that manner, containers of different heights could be simultaneously accommodated by the carrier at the two opposite ends of the carrier.

Accordingly, there is a topless container carrier which releasably supports containers which have no tops, that is, they are topless. The topless containers are cylindrical in shape, such as ordinary household cans with the tops removed, or they can be of rectilinear cross-section or any other configuration and they can contain small items such as nails and bolts. The carrier and the topless containers can also be utilized for containing hand-type garden tools or the like so that a home gardener can take the tools and supplies and the like in the containers and to the site and conveniently move the carrier around. As such, the reference to topless means that the tops of the containers are completely removed.

With the feature of inserting the topless containers into the slots 23 and then positioning the containers onto the shelves 18, all to secure the containers on the carrier, the containers can be of different heights and diameter, and all be on one carrier. Of course, the container diameters will determine the number of fingers 14 enclosed by each container, in order to accommodate the diametrical size of each container and to releasably hold the containers on one carrier.

What is claimed is:

1. A topless container carrier comprising two elongated pieces forming a T-shape and with each having an upright stem and an elongated portion disposed transverse to said stem, said stems having openings therein disposed to align with selected ones of each other when said stems are in adjacent and overlapping positions relative to each other, releasable fasteners disposed in selected ones of said openings for releasably receiving said pieces together to have said portions spaced apart at selected distances, fingers attached to one of said portions and pointed toward the other of said portions and being arranged to extend into an open top of a container positioned between said portions, whereby said other of said portions upwardly supports the container and said fingers hold the open top end of the container.

2. The topless container carrier as claimed in claim 1, for holding containers, wherein said elongated portions are disposed transverse to each side of each said stem, and including a plurality of said fingers attached to said elongated portions which are disposed on one of said stems for holding said containers on said carrier at each side of said stems.

3. The topless container carrier as claimed in claim 1, wherein said openings are located on said stems and include a plurality of said openings on each end of both said stems and being spaced apart such that two of said openings on one end of both of said stems are aligned to thereby establish a first distance between one end of one of said elongated portions and said fingers at one end of said elongated pieces, and two other of said openings on the other end of both of said stems are aligned to thereby establish a second distance between the other end of said one of said elongated portions and said fingers, and thereby said distances are of different lengths to accommodate different length containers at opposite ends of said carrier.

4. A topless container carrier comprising a plurality of containers without any tops to thereby be completely topless, a planarly extending flat shelf upon which said containers are positioned and upwardly supported in side-by-side relationship, a row of a plurality of alternating fingers and slots spaced above said shelf and with said row lying along one flat plane and with said fingers pointing downwardly only in the direction transverse to the plane of said shelf and being arranged for selectively extending into the open tops of said containers, and an uprightly disposed carrier portion interconnected with said shelf and said fingers for retaining the spacing therebetween to thereby releasably hold said containers of a selected height between said shelf and said fingers after said containers are first positioned to have said fingers extend into said open tops and then positioned to rest on said shelf.

5. The topless container carrier as claimed in claim 4, wherein said shelf and said fingers are equally offset to one side of said carrier portion for receiving and releasing the container therebetween.

6. The topless container carrier as claimed in claim 4, wherein said shelf and said fingers are co-extensive and disposed to receive said plurality of said containers in side-by-side relationship and with a plurality of said fingers disposed in each of said containers.

7. The topless container carrier as claimed in claim 4, wherein there is one of said shelf and a row of said plurality of said fingers on each side of said carrier portion, for releasably holding one of said containers at said each side of said carrier portion.

8. The topless container carrier as claimed in claim 7, wherein said carrier portion is extendable and contractable away and toward said shelf and said fingers for receiving containers of various heights.

9. The topless container carrier as claimed in claim 4, wherein said carrier portion is extendable and contractable away and toward said shelf and said fingers for receiving containers of various heights.

10. The topless container carrier as claimed in claim 4, wherein said carrier includes an affixed handle.

11. The topless container carrier as claimed in claim 10, wherein said carrier portion has an opening therein adjacent said shelf for receiving a handle of another carrier when said carrier is stacked upon another said carrier.

12. A topless container carrier comprising a structure of a T-shape in end elevational view thereof, said T-shape having an upright central stem and a lower portion and an upper portion relative to said stem and with said portions arranged to respectively present lower and upper cross portions of said T-shape and being spaced apart and extending transverse to said stem, said upper portion also including two planar sections extending therealong and on two respective planes parallel to said central stem and with said planar sections being located at the outer extremities of said upper portion, a row of a plurality of alternating fingers and slots included in and spaced apart along said two planar sections of said upper portion for extending into the open top of the container for holding the container, and said lower portion extending aligned with said fingers for receiving the bottom of the container to upwardly support the container on said carrier.

13. The topless container carrier as claimed in claim 12, wherein said stem exists in two separable portions which are adjustably movable toward and away from said upper and lower portions for holding containers of selectable heights.

14. The topless container carrier as claimed in claim 12 wherein said portions extend to both sides of said stem, and including said fingers on said upper portion on both sides of said stem for holding containers on both sides of said carrier.

15. A topless container and carrier assembly comprising a plurality of containers which are free of top covers, a flat shelf having a length extending in a direction along a flat plane and upon which said containers are upwardly supported, a row of a plurality of fingers and slots spaced above and being co-extensive with said shelf and being disposed with said row and said fingers extending only in a plane lying along said direction and with said fingers pointing downwardly toward said shelf only in the direction transverse thereto for selectively extending into the open tops of said containers when said containers are on said shelf in side-by-side relationship along said direction, the width of each of said fingers being such that a plurality of said fingers can extend into said open top of each of said container, each of said slots being of a width less than the width of each of said fingers snugly receiving said containers, and an uprightly disposed carrier portion interconnected with said shelf and said fingers for retaining the spacing therebetween to thereby releasably hold said containers of a selected height between said shelf and said fingers.

16. The topless container and carrier assembly as claimed in claim 15, wherein said fingers are spaced apart with one of said slots between every two of said fingers, and said containers each extend into two of said slots with a plurality of said fingers extending into each of said open tops in releasably retaining said containers on said carrier,

17. The topless container and carrier assembly as claimed in claim 16, wherein said carrier exists in two pieces which respectively include said shelf and said fingers, and said pieces being adjustable to selectively position said shelf and said fingers in various spacing therebetween to retain containers of heights matching said spacing.

18. The topless container and carrier assembly as claimed in claim 15, wherein said containers held on said carrier are of various cross-sectional sizes and a plurality of said fingers extending into each of said open tops for optimum holding of said containers on'said carrier.

* * * * *